US005388538A

United States Patent [19]

Chekroune et al.

[11] Patent Number: 5,388,538

[45] Date of Patent: Feb. 14, 1995

[54] DEVICE FOR CREATING A RAISED MOTIF ON A TUFTED TEXTILE MATERIAL

[76] Inventors: Marie-Louise Chekroune, 17 rue Beaufils, La Courneuve F-93120; Suzanne Chekroune, La FaudeS-Fulgent des Ormes, Belleme F-61130, both of France

[21] Appl. No.: 27,165

[22] PCT Filed: Apr. 2, 1992

[86] PCT No.: PCT/FR92/00295

§ 371 Date: Jul. 14, 1993

§ 102(e) Date: Jul. 14, 1993

[87] PCT Pub. No.: WO92/20852

PCT Pub. Date: Nov. 26, 1992

[30] Foreign Application Priority Data

May 14, 1991 [FR] France ..... 91 05787

[51] Int. Cl.[6] ..... D05B 3/00

[52] U.S. Cl. ..... 112/121.14

[58] Field of Search ..... 112/266.2, 121.14, 121.15, 112/410, 439, 402, 406, 409, 412, 418, 429, 262.1, 266.1, 266.2; 101/23, 32; 28/164, 159, 160; 26/2 R, 69 R

[56] References Cited

U.S. PATENT DOCUMENTS

| | | | |
|---|---|---|---|
| 359,142 | 3/1887 | Fechtman | 112/410 |
| 2,066,545 | 1/1937 | Shuttleworth | 112/410 |
| 2,172,224 | 9/1939 | Sailer | 112/410 |
| 2,607,042 | 8/1952 | Schloss | 112/410 |
| 5,103,747 | 4/1992 | Resta et al. | 112/121.14 X |
| 5,241,919 | 9/1993 | LaGreca | 112/410 |

FOREIGN PATENT DOCUMENTS

| | | | |
|---|---|---|---|
| 25996 | 4/1981 | European Pat. Off. | 112/410 |
| 61-48395 | 3/1986 | Japan | 112/121.14 |

*Primary Examiner*—Clifford D. Crowder
*Assistant Examiner*—Paul C. Lewis
*Attorney, Agent, or Firm*—Paul and Paul

[57] ABSTRACT

A device for creating a raised motif on a tufted textile material includes first and second frames jointly movable with respect to the material. Remote controls command driving devices to move the second frame on the material according to a design.

2 Claims, 4 Drawing Sheets

DEVICE FOR CREATING A RAISED MOTIF ON A TUFTED TEXTILE MATERIAL

The present invention concerns a process to create a raised motif, according to a given pattern, on a tufted textile material. It is also concerned with a device for implementing this process.

The invention has found a particularly advantageous usage in industries and arts and crafts that are concerned with carpet related textile materials.

A known process to create a raised motif on a tufted textile material, carpet for example, consists of cutting, according to the technique of engraving, the tufts found on the desired pattern. This known process has obtained good results on that which concerns the desired raised impression, but nevertheless is limited because it does not allow for, in the case of a plain textile, the possibility to associate the color to the design thus created. Inversely, processes that allow a colored decor to be obtained, such as weaving, ink projection, or the implementation of colored tufts, do not produce the raised effect.

Also, the technical problem to be solved by the means of the present invention is to propose a process in accordance with the preamble by which it will be possible to accomplish raised and colored motifs.

The solution to the technical problem given is, according to the present invention, notably remarkable as the said process consists of crushing the said tufts situated on the said pattern with the help of at least one crushing device, the said crushing device constituting, at least in part, the said motif.

Thus, the raised effect is obtained by crushing the tufts of the textile material whereas the color of the motif can vary at will according to the chosen color for the crushing device.

As an example, the crushing device is constituted by a jointed sewn thread that accomplishes a concave design in the textile material.

In another implementation mode of the process according to the invention, the crushing mode is constituted by a braided sewn element, such as a sewn cord with the help of invisible thread. One can thus obtain areas of raised motifs in relation to the concave areas made with the help of a jointed sewn thread.

It can be noted that the process of the present invention has the advantage in that it is non destructive. Indeed, the tufts are crushed and not cut as in the case of engraving work. It is possible, if so desired, in case of wear of the crushing device for example, to remove the crushing device and to straighten the tufts. The textile material thus returns to its original structure.

The implementation of the process that corresponds with the invention poses the difficulty that the surfaces of the textile material to be treated can be very large and currently there exists no controlling means by which the crushing operations anticipated by the invention can be carried out on such large areas.

Also, another technical problem to solve by the objective of the present invention is to propose a controlling device that allows for an easy implementation of the invention process.

A solution to this technical problem, specially meant for an industrial usage of the process that corresponds with the invention, consists of a controlling device that comprises two lateral parallel fixed rails, each presenting at least two longitudinal rails, called rail-bearing grooves, at least one pair of two adjacent transversal parallel rails jointly mobile, in which the extremities are susceptible to slide into the respective rail-bearing grooves, under the action of the first driving device, the said transversal rails being separated by an interval at least equal to the thickness of the said textile material and each presenting a tool-bearing longitudinal groove, at least one work bead carrying at least one needle, and one spool linked to the said work head, the work head and the spool being jointly mobile and susceptible to slide into the respective tool-bearing groove under the action of another driving device, the control means for monitoring the said firstand second driving devices so that the work head and the spool accomplish the said crushing mode by covering the pattern of the said motif.

In this system, the textile material is fixed while the transversal rails move to cover a certain length of the said textile material.

According to another system in which, on the contrary, the rails carrying the work head and the spool are fixed and the textile tissue mobile, the said controlling device consists of:

at least one pair of rails, called transversal rails, adjacent, parallel, separated by an interval at least equal to the thickness of the said textile material, and each presenting a tool-bearing longitudinal groove, at least one work head carrying at least one needle and at least one spool linked to the said work head, the work head and the spool being jointly mobile and susceptible to slide into the respective tool-bearing groove under the action of a driving device, means of running off the textile material through the interval, control means for controlling the said means of running off and driving devices in a way that the workhead and the spool accomplish the said crushing mode during the running off of the textile material.

Another solution to the aforesaid technical problem, for a more cottage industry implementation of the invention process consists of a device that comprises:

a first frame containing a first truss equipped with a first means of rolling on the said textile material, on the tuft side, and a first arm secured to the said first truss carrying a work head carrying at least one needle, a second frame containing a second truss equipped with a second means of rolling on the said textile material, on the opposite side of the tufts, and a second arm secured to the said second truss carrying a spool linked to the said work head, means of coupling to enable the said first and second frames to be jointly mobile, driving devices of the second frame and remote control means to control the said driving devices so that the work head and the spool perform the said crushing mode by covering the pattern of the said motif.

The advantage of this mode of achievement in relationship to the two previously described is that it allows the treatment of unlimited surfaces of textile material whose width is not limited by the length of the interval between the transversal rails.

The following description compared with the appended drawings, given by way of non-restricting examples, will give a good understanding of the invention and how it can be performed FIG. 1 is a cutaway drawing of the tufted textile material presenting a first raised motif manufactured according to the invention process.

Figure 1:
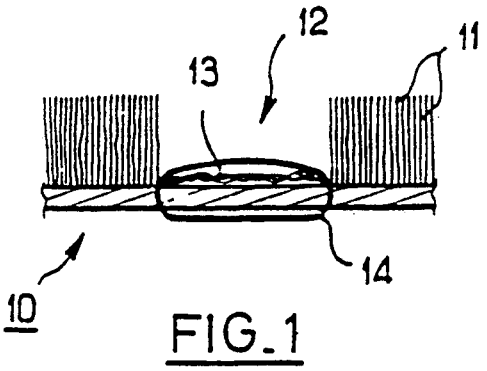
Figure 2:
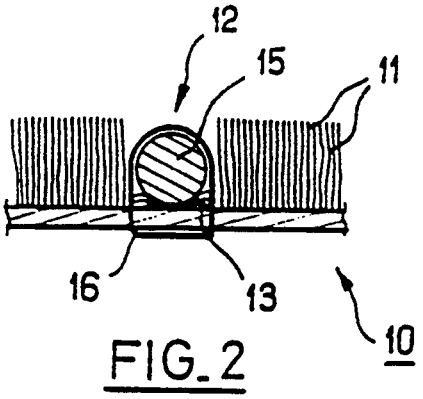
FIG. 2 is a cutaway drawing of the tufted textile material presenting a second raised motif manufactured according to the invention process.

FIG. 1 shows, by cutaway, a textile material 10 of a carpet type, presenting tufts 11. This textile material 10 contains a motif 12, traced according to a given drawing, created according to a process that consists of crushing the tufts 13 situated on the said drawing with the help of a crushing device that, in the example of diagram 1, is made by a jointed sewn thread 14. The color chosen for the thread 14 is in accordance with the desired motif.

In the mode of achievement shown in diagram 2, the said crushing mode consists of a sewn braided element 15, with the help of an invisible thread 16, for example. The braided element 15 can be a cord, as in diagram 2, or a braid, etc.

The three-dimensional drawing in diagram 3 represents by sketch the means of implementation of the process described compared to diagram 1 and 2. This controlling means contains two parallel and secured lateral rails 101, 102, each presenting two longitudinal grooves 111, 121 and 112, 122, called rail-bearing grooves. Two parallel and adjacent transversal rails 201, 202 make up the extremities 211, 212 that slide in the respective rail-bearing grooves 111, 121 under the action of the first driving devices not represented in the diagram 3, but that can be made up, for example, by a motor pulling a cable fixed to the extremities of the transversal rails 201, 202. The said first driving device must be such that the two transversal rails be jointly mobile, so that they can simultaneously move while remaining adjacent to each other.

As indicated in diagram 3, the said transversal rails 201, 202 are separated by an interval 210 at least equal to the thickness of the textile material to be treated and that, for reasons of clarity in the drawing, were not represented in the diagram 3. The transversal rails can thus be moved on either side of the said textile material, which remains fixed. With the goal of keeping the textile material sufficiently level, provision has been made so that the lateral rails 101, 102 each contain, at the height of the said interval 210, a third longitudinal intermediary groove 131, 132 placed between the two longitudinal 111, 121 and rail-bearing 112, 122 grooves, and intended to receive the said textile material.

Figure 3:
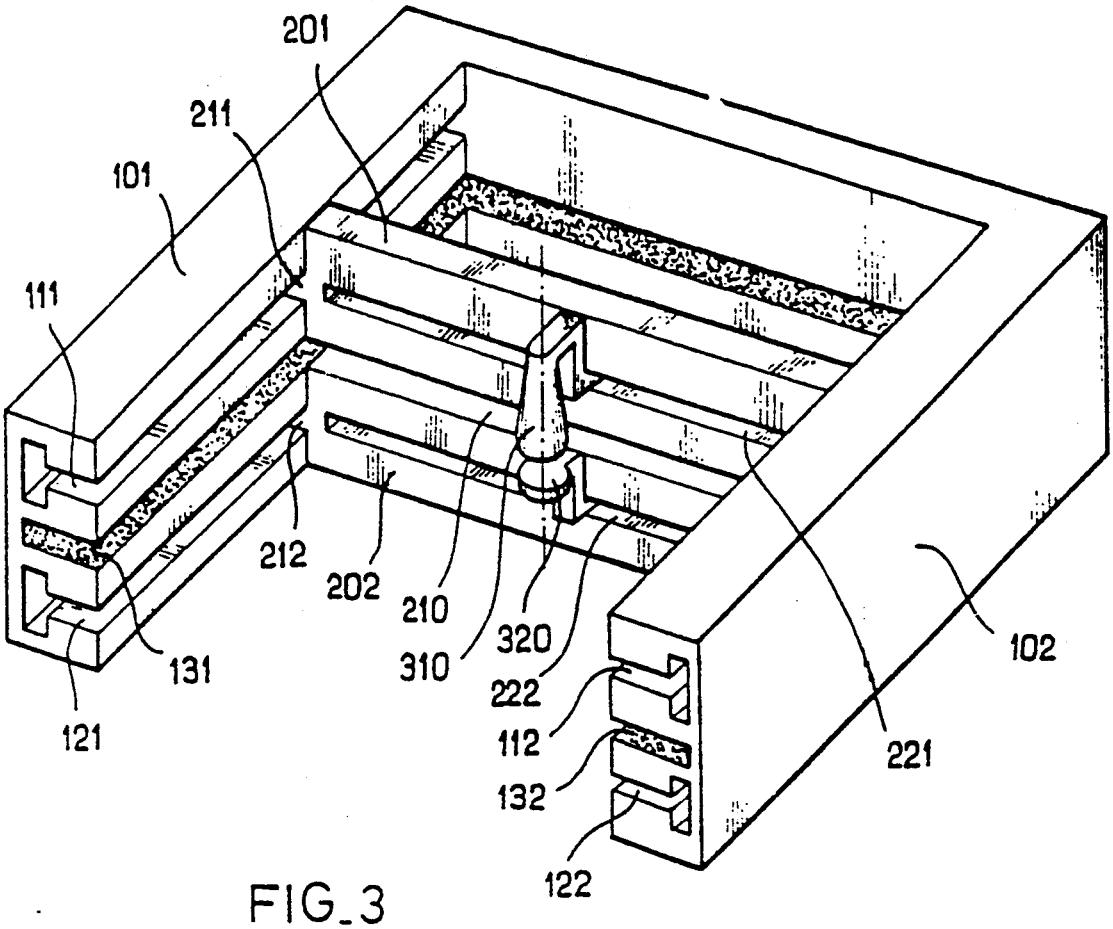
FIG. 3 is a three-dimensional drawing of a first mode of achievement or the implementation of the process in accordance with the invention.

You can see oil the FIG. 3 that the transversal rails 201, 202 each present a longitudinal 221, 222 tool-bearing groove. A work head 310 carrying at least one needle and one spool 320 linked to the said work head slide into the respective tool-bearing groove 221,222 under the action of the second driving devices of the same type as the first driving devices of the transversal rails 201, 202. The work head 310 and the spool 320 are jointly mobile in such a way that they stay in coincidence and can thus work together normally in the way, for example, of a classic sewing machine to accomplish the crushing of the related tufts in the form of a jointed sewn thread or a sewn braided element.

The initial and second driving devices (312, 322) are controlled by control means such as the computer 400 shown by the diagram 4, in a way that the work head 310 and the spool 320 cover the drawing of the motif to be accomplished.

The devices or the diagrams 3 and 4 operate like a tracing table: the motif design is stored in the memory of the computer in the form of a function D(X,Y) of the coordinates X,Y indicated by the diagram 4. The first and second driving devices (312, 322) are thus controlled by the program of computer 400 in a synchronized manner so that the trajectory of the work head 310 and the spool 320, resulting from the combinations of the movement in X and in Y, produced respectively by the first and second driving devices (312, 322), reconstitute the function D(X,Y) of the design.

Figure 4:
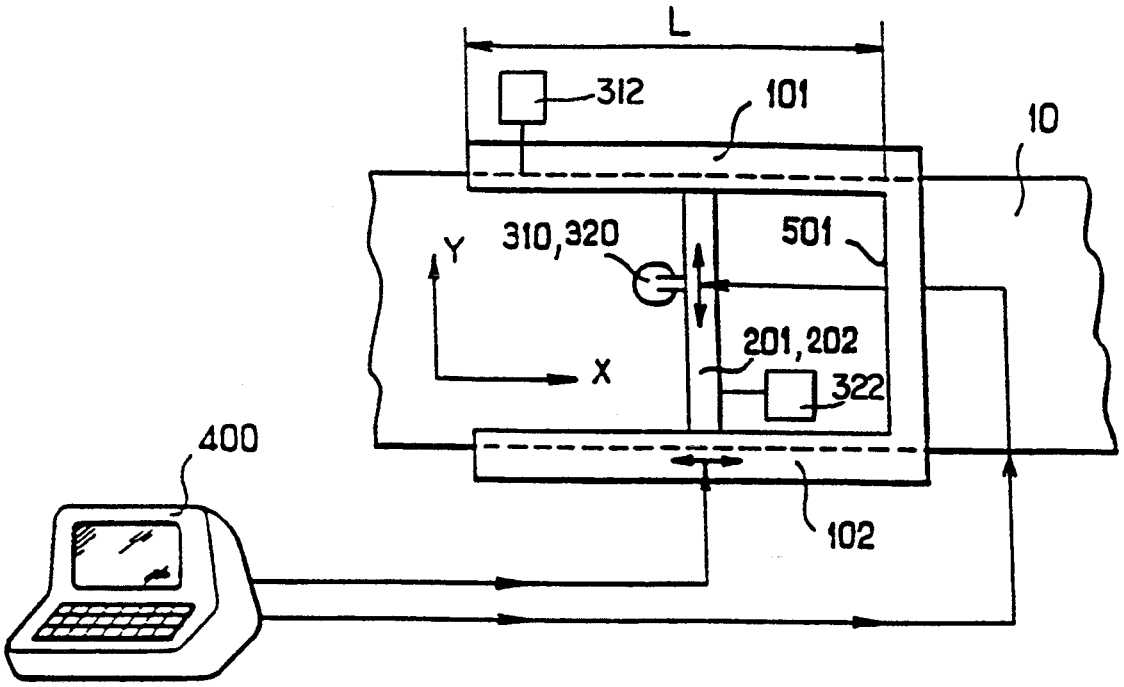
FIG. 4 is a functional diagram of the device set out in diagram 3.
Figure 5:
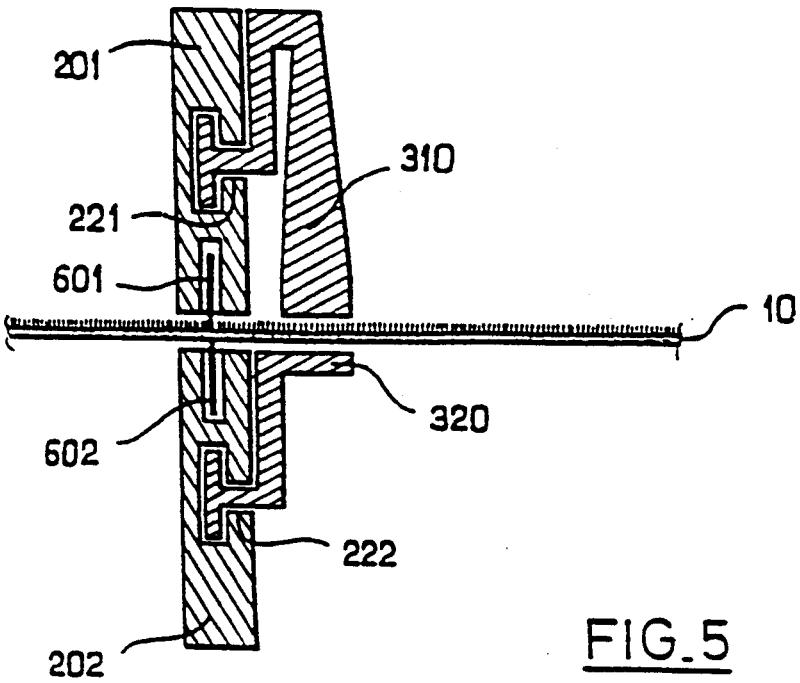
FIG. 5 is a cutaway drawing of the device set out in diagram 3.
Figure 6:
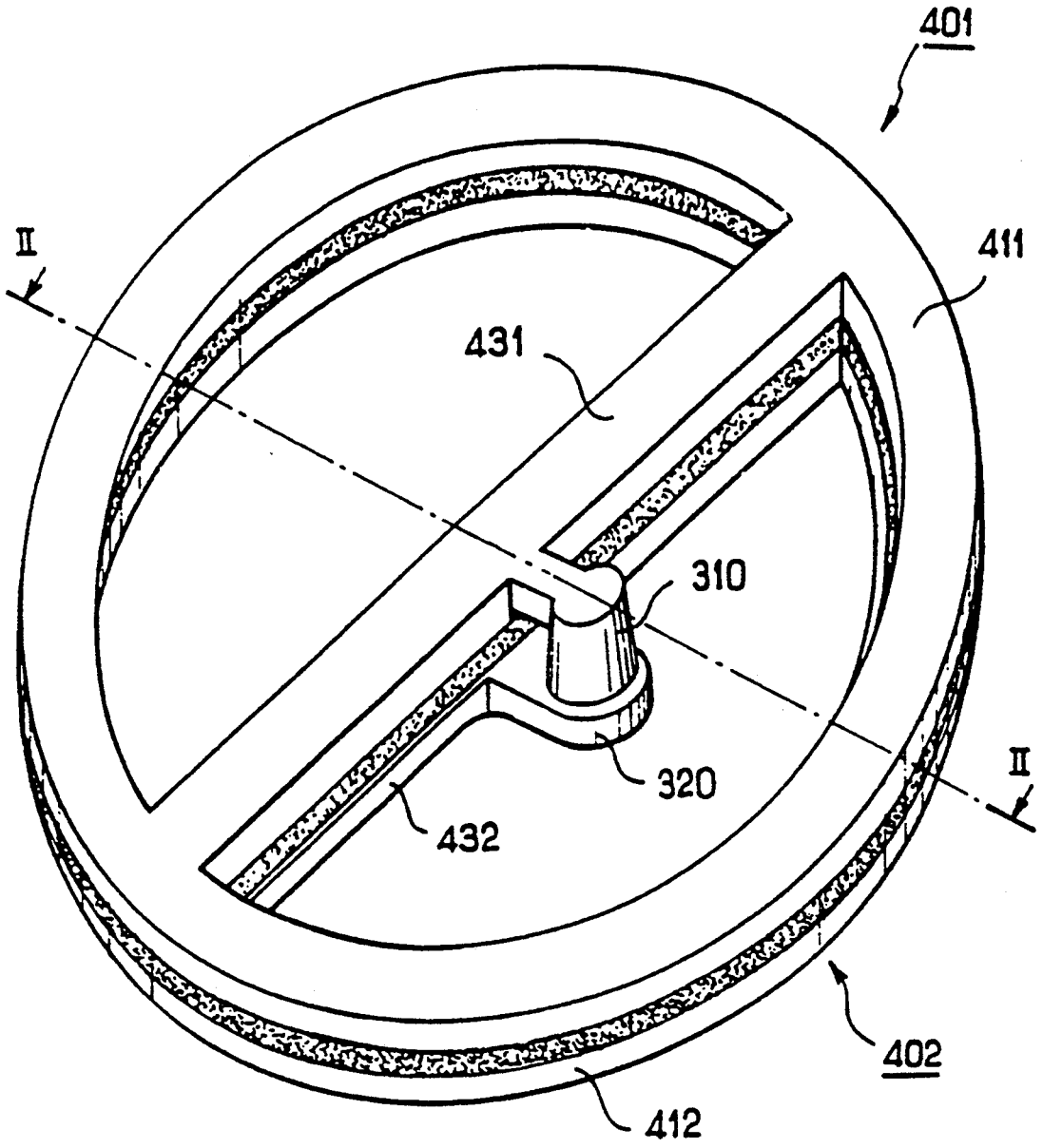
FIG. 6 is a three-dimensional drawing of a second mode of achievement or the device according to the invention.
Figure 7:
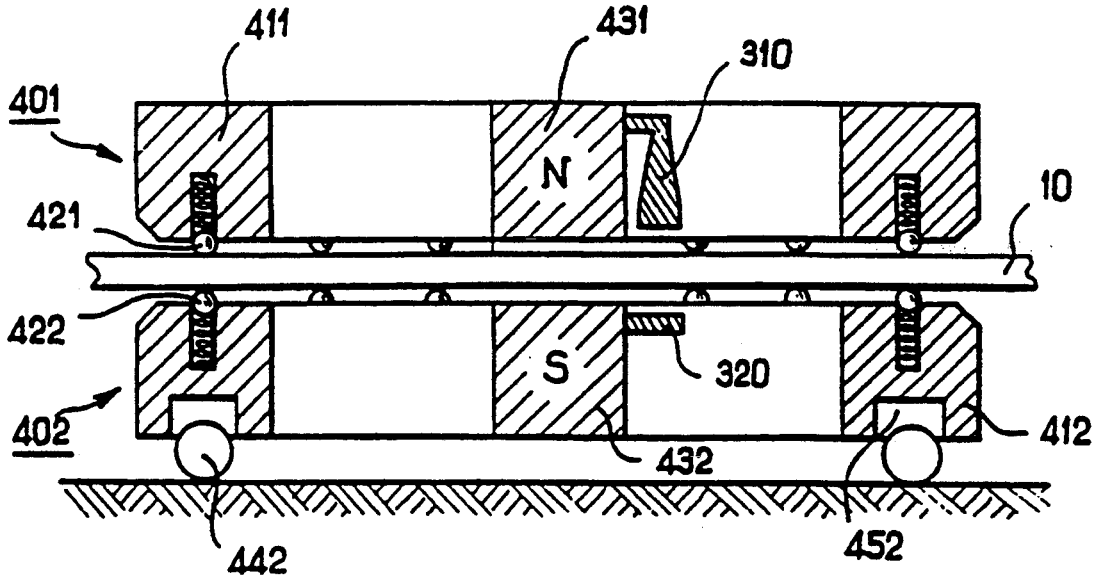
FIG. 7 is a cutaway drawing according to the line II—II or the diagram 6 three-dimensional drawing.
Figure 8:
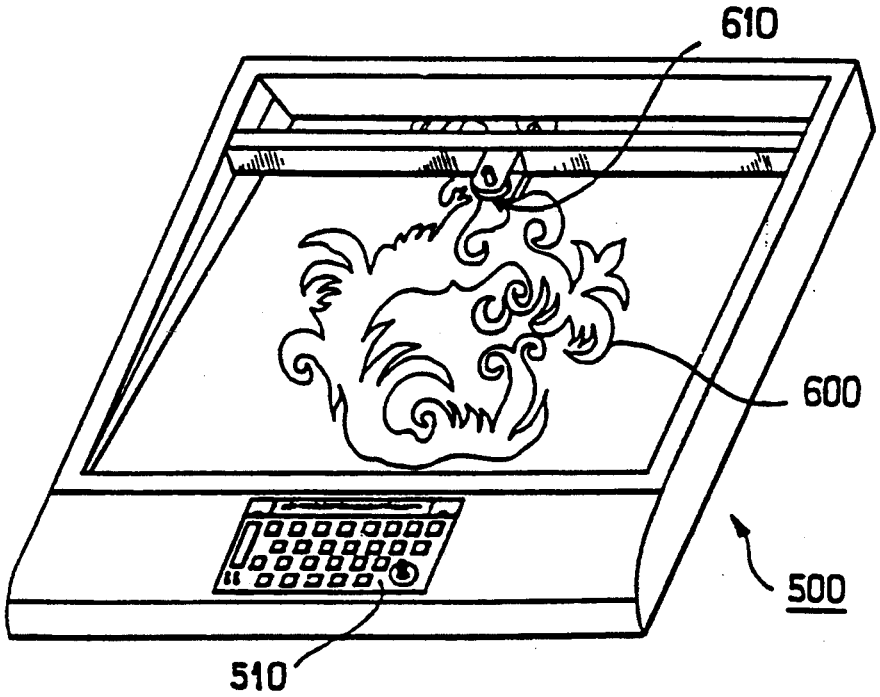
FIG. 8 is a three-dimensional view of the remote control console of the diagrams 6 and 7 device.

In a practical way, the transversal rails 201, 202 cover the L route offered by the longitudinal rails 101, 102 by moving in the same direction beginning with, for example, the extremity 501 shown in FIG. 4. During this movement, the textile material 10 engaged in the controlling means stays attached. Then, when the transversal rails come to the end of route L, the first driving devices bring back the said transversal rails to their point of departure 501. In a way so as to put into position a new surface of textile material to be treated, the transversal rails 201, 202 are equipped with driving devices of the textile material 10, constituted, for example, by the blades 601, 602, forming a jaw that holds tight the textile material during the return of the transversal rails to their initial position. The blades 601, 602 are then freed and the transversal rails can again move in relation to the fixed textile material.

It is understood that the transversal rails 201, 202 can carry, in the same tool-bearing grooves 221,222, several sets of work heads 310—spools 320 driven by respective second driving devices, and assigned to, for example, different colors of thread.

In the same way, the device of the invention is not limited to the mode of achievement previously described in which the transversal rails move in relationship to the fixed textile material. The said rails can also be fixed and the textile material move past, with the help of a means of proceeding, through the interval 210, the unit work head 310—spool 320 only moves along the tool-bearing grooves 221, 222 under the action of the driving devices constituted solely by the second driving devices.

In this case, the first driving devices are absent or uncontrolled by the means of control. The said means of control thus command the means of running off and driving devices in a way that the work head 310 and the spool 320 accomplish the said means of widening during the running off of the used material 10.

It must also be noticed that the device according to the invention can include several parallel pairs of longitudinal rails each carrying one or several different colored work heads, thus allowing the accomplishment of complex motifs. This layout is particularly advantageous in the mode of achievement with fixed longitudinal rails and running textile material.

Diagrams 6, 7, and 8 illustrate a mode of achievement of the device of the invention that allow the treatment of the surface of a textile material 10 already in place, without any limitation concerning the width, the textile material remaining in a fixed position. This mode of achievement presents the particularity in that it is able to be transported on the site.

In accordance with the diagrams 6 and 7, the device includes a first frame 401 including a first truss 411 equipped with first means of rolling 421 on the textile material 10, on the tufted side, made up of balls mounted on a spring, for example. The first frame 401 also includes a first arm 431 jointed to the first armature 411 and carrying a work head 310 carrying at least one needle.

A second frame 402 contains a second truss 412 equipped with a second means of rolling 422 on the textile material, on the side opposite of the tufts, similar to the said first means of rolling 421.

The second frame 402 contains as well a second arm 432 secured to the said second armature and carrying a spool 320 linked to the work head 310.

In a way so as to maintain on permanent coincidence the work head 310 with the spool 320, means of coupling are supplied so as to render jointly mobile the said first 401 and second 402 frames. As indicated in diagram 7, these means of coupling can be magnetic, polar parts N and S making up the arms 431 and 432 for example.

The second frame 402 contains driving devices 442 made of adjustable small wheels which are remote controlled so that the work head 310 and the spool 320 accomplish the crushing mode while covering the motif design.

The diagram 8 indicates that the said remote control devices can be made up of, for example, a console 500 that controls the operation of the motors 452 connected to the driving devices 442. The console 500 includes the drawing 600 of the motif to be performed that the operator follows with the help of a stylet 610 whose movement is radioelectrically transmitted to the driving devices 442.

A keyboard 510 allows the selection of the chosen stitch or the scale ratio to be applied between the drawing 600 and the corresponding dimensions of the motif.

It is understood that the remote control can also be performed by computer that executes a program stored in its memory and whose parameters can be modified at will from a keyboard.

We claim:

1. A device for making a raised motif, according to a given design, on a textile material having a tufted side and second side, by crushing tufts to form the design using a crushing means selected from joined sewn thread and woven braid, the crushing means thus making up at least in part the raised motif, the device comprising:

(a) a first frame including
- a first armature having a first means for rolling on the tufted side of the textile material,
- a first arm secured to said first armature and carrying a work head carrying at least one needle, and
- a first coupling device;

(b) a second frame including
- a second armature having a second means for rolling on the second side of the textile material,
- a second arm secured to said second armature and carrying a spool, and
- a second coupling device, the second coupling device being coupled to the first coupling device, the first coupling device and the second coupling device making the first frame and the second frame jointly mobile;

(d) driving devices for moving the second frame on the textile material; and (e) remote controls to command at a distance the driving devices so that the work head and spool cooperate to apply the crushing means to the textile material according to the design.

2. A device according to claim 1 wherein the coupling devices are magnetic devices.

* * * * *